United States Patent [19]

Hagbjer

[11] Patent Number: 4,527,371

[45] Date of Patent: Jul. 9, 1985

[54] STRUCTURAL DAMPING

[75] Inventor: Gunnar Hagbjer, Malmö, Sweden

[73] Assignee: IFM-Akustikbyran AB, Stockholm, Sweden

[21] Appl. No.: 466,382

[22] PCT Filed: Jun. 15, 1982

[86] PCT No.: PCT/SE82/00215

§ 371 Date: Feb. 14, 1983

§ 102(e) Date: Feb. 14, 1983

[87] PCT Pub. No.: WO82/04454

PCT Pub. Date: Dec. 23, 1982

[30] Foreign Application Priority Data

Jun. 15, 1981 [SE] Sweden ..... 8103748
Jun. 15, 1981 [SE] Sweden ..... 8103749

[51] Int. Cl.[3] ..... E04C 1/00; F16F 7/10; E04B 1/98

[52] U.S. Cl. ..... 52/309.16; 52/731; 188/378; 267/136

[58] Field of Search ..... 52/400, 167, 309.1, 52/309.16, 309.17, 309.6, 309.7, 144, 145, 802, 809, 822, 823, 824, 825, 826, 827, 828, 829, 830, 403, 396, 601, 602, 729, 730, 731; 248/562, 568, 569, 570, 610, 636; 188/378; 267/136

[56] References Cited

U.S. PATENT DOCUMENTS

| | | | |
|---|---|---|---|
| 1,815,558 | 7/1931 | Gammeter | 428/167 |
| 3,078,969 | 2/1963 | Campbell et al. | 52/403 |
| 3,078,971 | 2/1963 | Wallerstein, Jr. | 52/403 |
| 3,169,881 | 2/1965 | Bodine, Jr. | 428/157 |
| 3,172,800 | 3/1965 | Truesdell | 52/823 |
| 3,215,225 | 11/1965 | Kirschner | 428/444 |
| 3,262,521 | 7/1966 | Warnaka | 52/785 |
| 3,266,966 | 8/1966 | Patchell | 428/169 |
| 3,402,560 | 9/1968 | Alm | 52/144 |
| 3,448,550 | 6/1969 | Herr et al. | 52/731 |
| 3,828,504 | 8/1974 | Egerborg et al. | 52/396 |
| 3,956,563 | 5/1976 | Spang et al. | 428/327 |
| 4,133,157 | 1/1979 | Bschorr et al. | 52/167 |
| 4,278,726 | 7/1981 | Wieme | 248/636 |
| 4,382,587 | 5/1983 | Heinrich et al. | 188/378 |
| 4,425,980 | 1/1984 | Miles | 52/806 |

FOREIGN PATENT DOCUMENTS

| | | | |
|---|---|---|---|
| 2621130 | 11/1977 | Fed. Rep. of Germany | 267/136 |

*Primary Examiner*—John E. Murtagh
*Assistant Examiner*—Andrew Joseph Rudy
*Attorney, Agent, or Firm*—James C. Wray

[57] ABSTRACT

For improved vibration damping are used preferably a plurality of parallel bodies (30) of generally thread-like configuration which are embedded in a layer of adherent viscoelastic material (29) applied to a vibrating structure or to a body (24) which in turn rests against a vibrating structure (22).

3 Claims, 27 Drawing Figures

FIG. 21
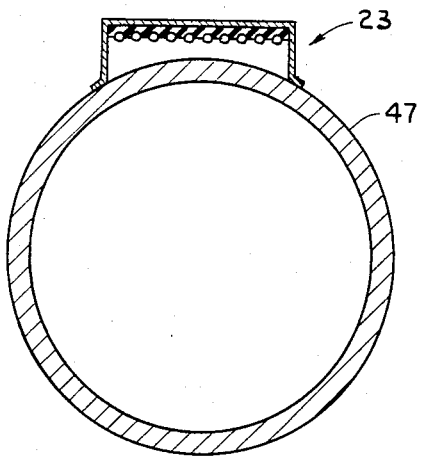
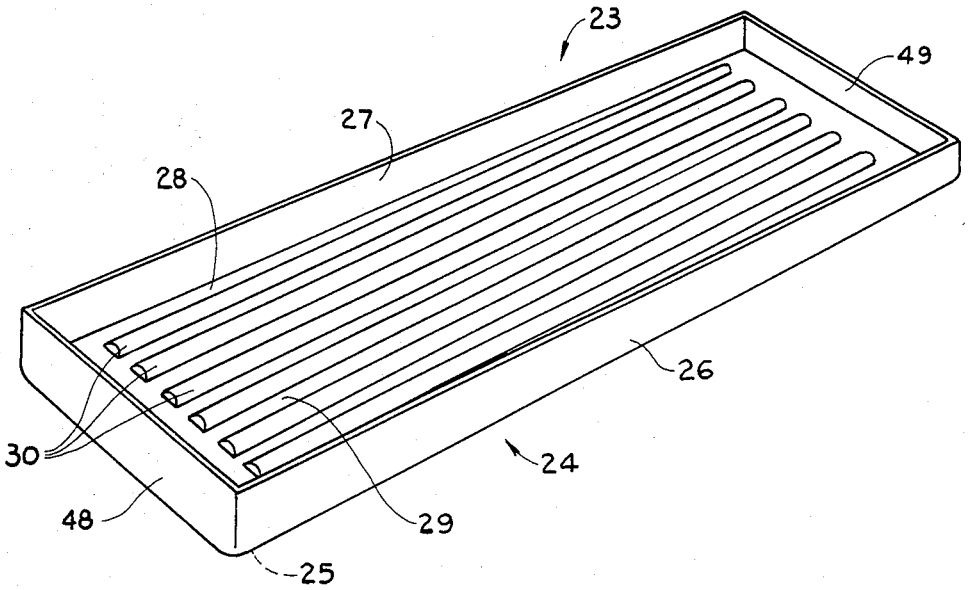
FIG. 22

STRUCTURAL DAMPING

The present invention refers to damping of structural vibrations and more particularly to such damping by the use of an adherent viscoelastic material and at least one counter body. The invention also refers to a damping apparatus utilizing the general principles of the invention.

As is well known in the art of vibration damping a viscoelastic material has the property to absorb vibration energy, i.e. to transform vibration energy into heat, when such a material is subjected to shearing between two covibrating parts, such as metal plates, between which the viscoelastic material is applied in a relatively thin layer adhering to both parts such that shearing is developed in the layer when the parts oscillate in a bending mode due to vibrations.

This technique and the theories behind it are described in e.g. "Noise and Vibration Control", edited by Leo L. Beranek and published by Mc Graw-Hill Book Company, New York, in 1971 (ISBN 07-004841-X).

Also, a great number of patents have been granted concerning various practical developments of the basic technique referred to above, such as U.S. Pat. Nos. 3,078,969; 3,078,971; 3,169,881; 3,215,225; 3,262,521; 3,828,504; 3,956,563; and 4,195,713, the three last mentioned patents having the inventor of the present invention as co-inventor.

In all applications of viscoelastic damping known to the Applicant only the energy dissipation in the viscoelastic material due to pure shearing—developed as discussed above—is utilized to damp structural vibrations. For example, a structure can be damped by applying an adhering layer of viscoelastic material to a plane surface of the structure and applying a separate, normally comparatively thin plate as a counter body onto the viscoelastic material. In such cases damping is achieved only by pure shearing in the viscoelastic material due to relative movements of the structure and the separate plate in any direction along the plane separating the structure and the plate.

Now, the inventor has made the astonishing discovery that if the counter body is so shaped and arranged that it may perform a lateral swinging or tilting motion relative to its longitudinal direction, a new and astonishing damping effect is added to the conventional damping caused by shearing in the viscoelastic layer. If, further, the length of the counter body is adapted to the longitudinal wave length in the material of the counter body also damping of longitudinal waves is obtained in a structure by shearing in the viscoelastic layer. A preferred shape of the counter body is one having a generally thread-like or rod-like configuration of circular or other cross-section.

The present invention, thus, is primarily characterized in that the counter body is generally thread- or rod-shaped and embedded in the viscoelastic material such that it has a possibility to oscillate in resonance relative to a structure under deformation of the viscoelastic material around portions of the counter body embedded therein when the viscoelastic material adheres to a vibrating structure.

The invention will now be described more in detail, reference being made to the accompanying drawings, wherein:

FIG. 1 is a perspective view showing a cut-out portion of a structure damped according to the invention;

FIGS. 2*a* and 2*b* show a section along line II—II of FIG. 1, FIG. 2*a* illustrating the structure at rest and FIG. 2*b* illustrating same in a strongly exaggerated transversal oscillation in vertical direction;

FIGS. 3*a, b* and *c* show a section along line III—III of FIG. 1, FIG. 3*a* illustrating the counter body in rest position while FIGS. 3*b* and 3*c* show same swinging leftwards and rightwards, respectively;

FIG. 4*a* shows from the above the structure of FIG. 1 set in strongly exaggerated transversal oscillation in horizontal direction;

FIG. 4*b* shows a section along line IVb—IVb of FIG. 4*a;*

FIG. 4*c* shows a section along line IVc—IVc of FIG. 4*a;*

FIG. 21 shows a cross section through a tube damped according to the invention; and FIG. 22 illustrates with a perspective view the manufacture of an apparatus according to the invention.

Figure 1:
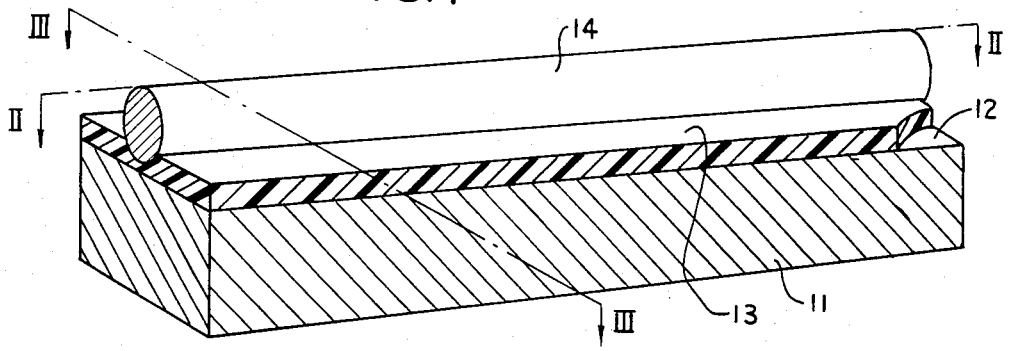

In FIG. 1, 11 is a portion of a vibrating structure which is damped according to the invention. This structure, e.g., can be an engine, a building structure, a staircase, or any structure of any structural material that vibrates and/or emits noise due to its use or otherwise. Onto one surface 12 of the structure 11 is applied a layer 13 of a viscoelastic material adhering to the surface 12. As is usual in the art of viscoelastic damping a counter body is applied on the viscoelastic layer. According to the invention this counter body is a generally thread- or rod-shaped body 14, which according to FIG. 3*a* has a circular cross-section and is partly embedded in the viscoelastic layer 13 and partly protrudes therefrom such that the mass centre M of its cross-section is located above or outside the plane of the surface of the viscoelastic layer 13.

Figure 2A:
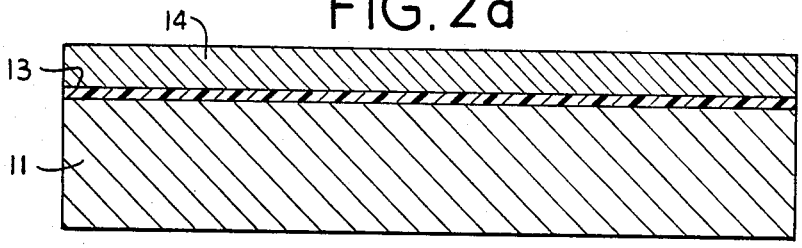
Figure 2B:
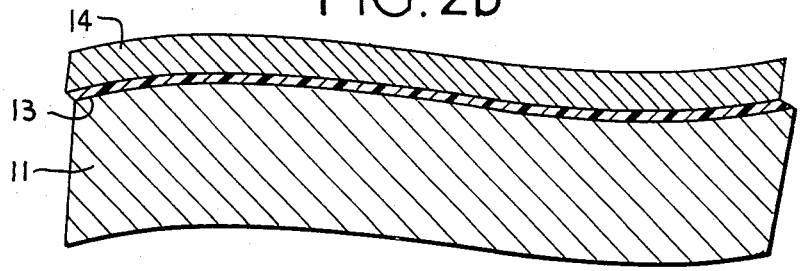

As in conventional viscoelastic damping, where a generally plate-like counter body is used, damping is obtained by longitudinal shearing in the viscoelastic layer 13 when the structure 11 flexes in a bending mode according to FIG. 2*b*.

Figures 3A, 3B, 3C:
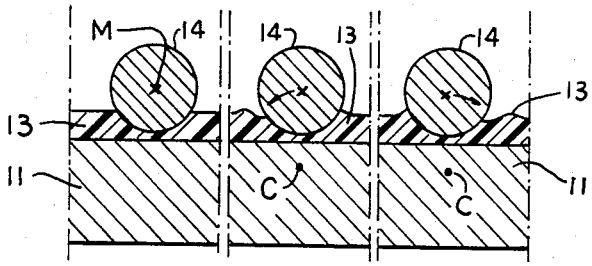

Due to the configuration of the counter body and its location in the viscoelastic layer the counter body is able, particularly at lower frequencies, also to tilt or rotate laterally in resonance with the frequency of the vibration. Examples of this effect are shown in FIGS. 3*b* and *c*, the tilting or rotation in this first mode taking place about a centre of rotation C, which is located underneath the body, the viscoelastic material being deformed on either side of the body. This cyclic deformation of the viscoelastic material will cause further dissipation of energy and, thus, further damping.

At higher frequencies the counter body in a second mode may start rotating forth and back about a centre of rotation located above the body (not shown).

Figure 4A:
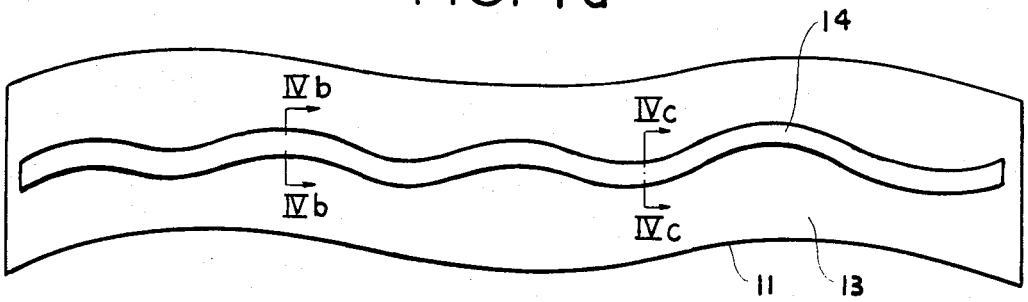

At higher frequencies the counter body 14 may also oscillate in bending with another bending wave length than the structure 11 (FIG. 4*a*). Thereby partly occur shearing deformations in the layer 13 due to horizontal movements in the counter body 14 (FIGS. 4*b* and 4*c*) and partly deformation at compression of layer 13 for vertical (relative to a horizontal surface) movements of the counter body (not shown).

Figures 4B, 4C:
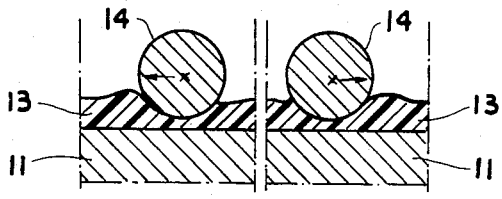
Figures 5, 6, 7, 8:
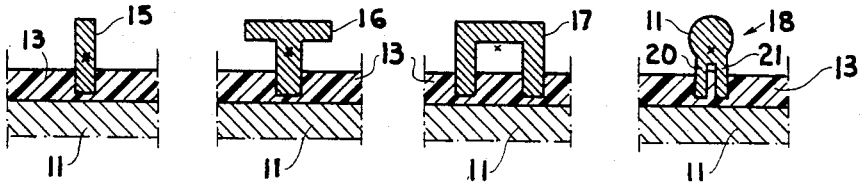
FIGS. 5, 6, 7 and 8 show one example each of alternative counter bodies.

The actual movements of the counter body may very well and most likely be a combination of the movements now described and shown in FIGS. 2, 3 and 4. If, for instance, the cross-section of FIG. 4*b* is imparted a rotational or tilting movement as that of FIG. 3*b* and at the same time the cross-section of FIG. 4*c* is imparted a rotational or tilting movement as that of FIG. 3*c*, the counter body will be torsionally twisted between these cross-sections, which will also contribute to the energy losses and, thus, further damping.

In FIGS. 5, 6, 7 and 8 are shown examples of other cross-sections of the counter body, a rectangular cross-section 15, a T-shaped cross-section 16, a U-shaped cross-section 17 and a cross-section 18 having a cylindrical portion 19 and two legs 20, 21 between which is a relatively narrow slot, in which the viscoelastic material 13 by capillary action can be sucked up, thereby giving the counter body a greater area of adherence.

Figure 9:
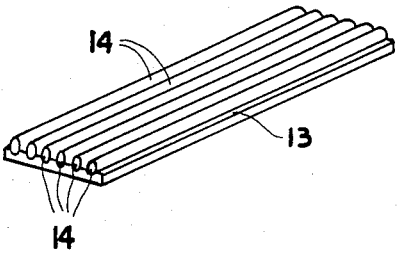
FIG. 9 shows a perspective view of several thread- or rod-shaped counter bodies applied in a viscoelastic layer.
Figure 10:
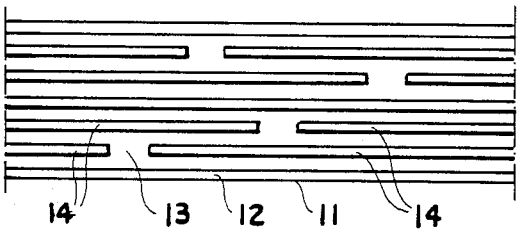
FIG. 10 shows from above an example of an application of the invention.

For obtaining satisfactory damping results, advantageously a plurality of preferably parallel counter bodies 14 are employed as shown in FIG. 9. A plurality of counter bodies 14 may also be arranged in a row after each other, and, for optimizing the damping result, the inter-spaces in the longitudinal direction may be displaced or staggered according to FIG. 10.

For damping of longitudinal waves in the structure 11 the optimum length of each counter body 14 is a multiple of a forth of the longitudinal wave length in the material of a counter body.

In carrying out the invention the viscoelastic layer 13 may be applied onto a surface of a structure to be damped and the counter body or bodies 14 be put into the uncured viscoelastic material, or, may the viscoelastic layer be spread out onto a plastic sheet or other substratum to which is does not adhere, and the counter body or bodies be put into the uncured viscoelastic material, which, after curing, may be removed from the substratum together with the counter body or bodies (FIG. 9), and thereafter be applied, e.g. by glueing, onto a surface of a structure to be damped.

It is not necessary that the counter body is in contact with the viscoelastic layer along its entire extension as is shown on the drawings, but is may adhere thereto only at spaced locations, or may the viscoelastic layer have interruptions, such that the counter body is free on such locations.

The counter body needs not have constant cross-section, but may have spaced portions having for instance contracted cross-section of greater or less extension.

In practical tests utilizing the principles of the invention excellent damping results have been achieved. As example counter bodies have been used having circular cross-sections of 2–8 mm diameter, viscoelastic layers having thicknesses between 1 and 3 mm and submersion depths for the counter body in the viscoelastic layer between 1 and 3 mm.

Within certain limits the cross-sectional dimension of the counter body, the thickness (shearing modulus) of the viscoelastic layer, and the submersion depths of the counter body in the layer can be calculated for optimum damping effect at known frequency of disturbance and temperature.

Figure 11:
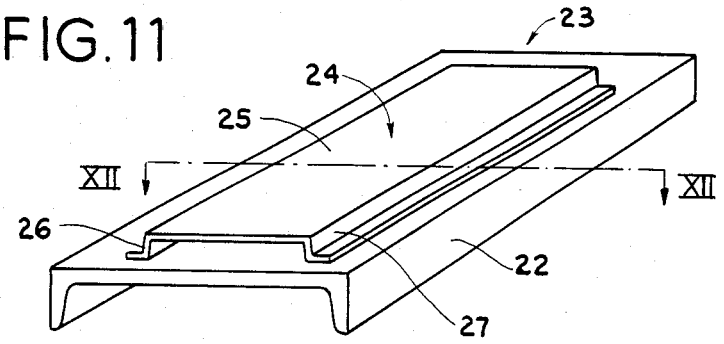
FIG. 11 is a perspective view of a damping apparatus utilizing the principles of the invention in damping a beam.

FIG. 11 shows a structure 22 in the shape of a U-beam, which is damped against vibrations with a damping apparatus 23 according to the invention. In this embodiment the damping apparatus 23 comprises an extended body 24 of e.g. steel plate, aluminum plate or a suitable plastic material, which is bent or formed to U-shape and has a web portion 25 and two fastening and spacing flanges 26 and 27 extending therefrom. On the inner surface 28 of the web portion 25, which is invisible in FIG. 11, is applied a layer 29 (FIG. 12) of viscoelastic material that adheres to the surface 28. In the layer 29 is adherently applied one or preferably a plurality of counter bodies 30 in the form of parallel threads or rods of suitable stiffness.

Figure 12:
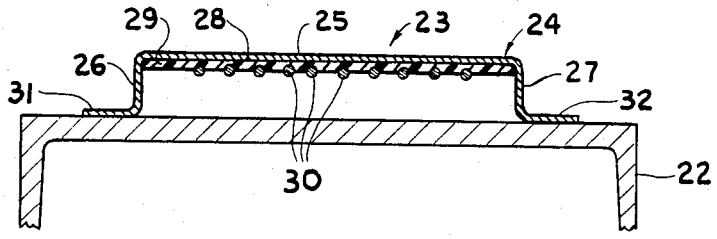
FIG. 12 is a section along line XII—XII of FIG. 11 showing a preferred embodiment of the damping apparatus of the invention.

The fastening and spacing flanges 26, 27 serve for the mechanical connection of the apparatus to a structure 22 as well as for spacing the web portion 25 and therewith the viscoelastic layer 29 and the counter bodies 30 from the structure 22, thereby to achieve a higher efficiency of damping. In the embodiment of FIGS. 11 and 12 the flanges 26 and 27 have portions 31 and 32, respectively, which are bent out at right angles and by means of which the body 24 is connected to the structure 22 such that vibrations of the structure are transmitted to the body 24. The bent out portions 31 and 32 may be attached to the body 24 in any suitable way not specifically shown, such as by screwing, riveting, spot welding, glueing, or casting. The body 24 may have open or closed ends, i.e. continuous U-shape or open box-shape.

Figure 13:
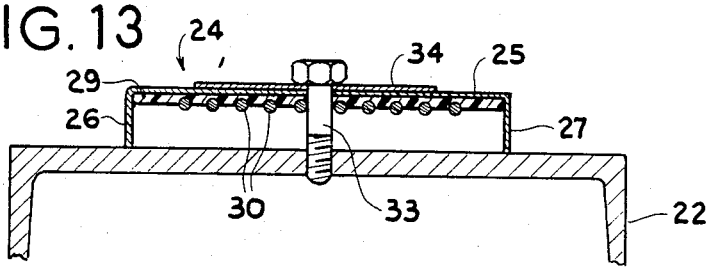
FIG. 13 shows an example of how the damping apparatus of the invention is attachable to a structure.

FIG. 13 shows another example of how the body 24 can be attached to a structure 22. A screw 33 by means of a washer 34 pulls the body 24 towards the structure 22 with such great force, that there is sufficient great friction between the flanges 26, 27 and the structure to transmit the vibrations of the structure 22 to the body 24.

Figure 14:
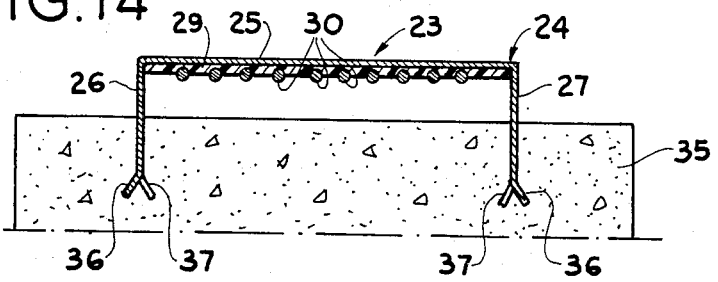
FIG. 14 shows an example of how the damping apparatus of the invention is attachable to a concrete structure.

FIG. 14 shows an apparatus according to the invention used for damping of a cast structure, in this instance a concrete structure 35, the fastening and spacing flanges 26 and 27 being provided with angled flaps 36, 37 which—together with portions of the flanges 26 and 27—are cast into the structure 35.

In order to widely optimize the damping obtainable with the apparatus according to the present invention primarily four parameters can be varied, viz. the distance between the web portion 25 and the structure to be damped, i.e. the effective height of the flanges 26 and 27, the width of the body 24, the properties of the viscoelastic layer—particularly its thickness—and, for the counter bodies, their cross-section, their submersion depth in the layer 29, their lengths and their number. Further, the material thickness of the body 24 can be adapted to the dimensions of the counter bodies.

Figure 15:
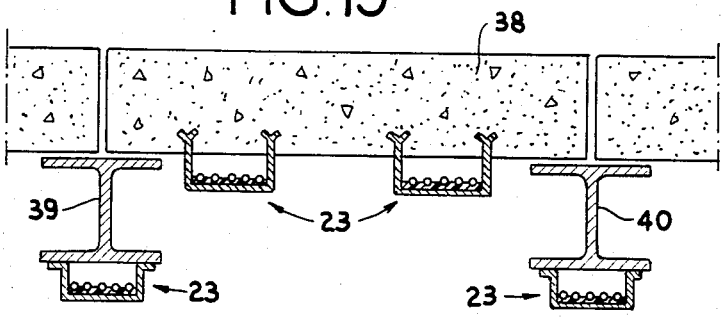
FIGS. 15–18 show schematically various examples of application of the invention in constructional connection.
Figure 16:
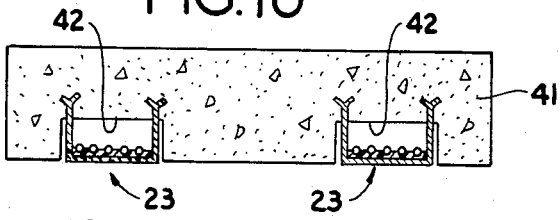
Figure 17:
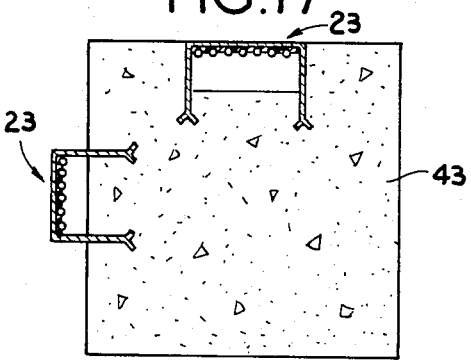

FIGS. 15–17 show very schematically some applications of the invention on building structures.

FIG. 15 shows a vertical section through a flooring slab 38 of concrete, which rests on two beams 39 and 40. In the underside of the slab 38 are cast-in two apparatuses 23, e.g. according to FIG. 14. Additionally, on the lower flange of the respective beam 39, 40 is mounted an apparatus 23, e.g. according to FIG. 12.

FIG. 16 shows a section through a concrete slab 41, which may be horizontal or vertical. The slab 41 is provided with recesses 42, in which are cast-in apparatuses 23, e.g. according to FIG. 14.

FIG. 17 shows a horizontal section through a concrete pillar 43, in which are cast-in two apparatuses 23 according to e.g. FIG. 14, of which one is externally mounted and the other is let in.

Figure 18:
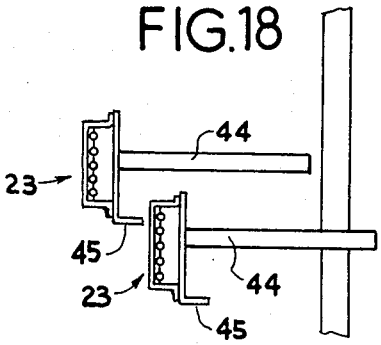

FIG. 18 shows how the apparatus according to the invention can be mounted onto steps 44 of a helical staircase, in this case at the back edge of the respective step on a L-beam 45 carrying the step.

Figure 19:
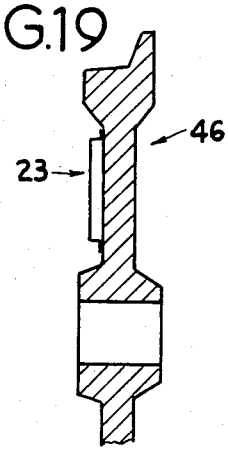
FIGS. 19 and 20 show in a part axial section and a corresponding side view, respectively, the application of the invention on a wheel.
Figure 20:
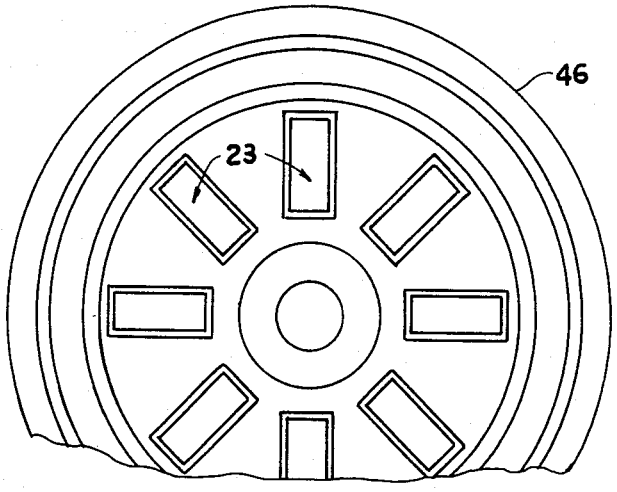

In FIGS. 19 and 20 is shown the application of the invention on a wheel 46. A plurality of apparatuses 23 are radially mounted with equal or other suitable angular spacing.

In FIG. 21 is shown a cross-section through a tube 47, along the outer surface of which is mounted an apparatus 23, e.g. according to FIG. 12.

As is readily appreciated, the damping apparatus of the invention provides an excellent mechanical protection for the viscoelastic layer as well as for the counter bodies.

Apart from the pure damping advantages an apparatus according to the invention is also simple to manufacture. Thus, the substantially U-shaped body 24 is used as a mould according to FIG. 22. For this purpose the body 24 suitably has closed ends 48, 49 i.e. its web portion 25 forms the bottom and its flanges 26, 27 and ends 48, 49 form the walls of an upwardly open box, in which is cast a suitable amount of viscoelastic material 29, whereafter a number of counter bodies 30 are put into the non-cured viscoelastic material. After curing of the viscoelastic material the apparatus 23 is ready for use.

I claim:

1. Apparatus for damping vibrations in a structure (22) comprising a first body (24), a layer of adherent viscoelastic material (29) and at least one second body (30), said first body being a generally U-shaped body having a web portion (25) and two spacing flanges (26,27) extending therefrom, said flanges (26,27) being adapted to space said web portion (25) from said structure (22), characterized by said viscoelastic material being applied to the surface (28) of said web portion (25) intended to face said structure; said second body (30) being a generally thread or rod shaped body adherently partially embedded in said viscoelastic material; and fastening means (31,32;13;36,37) being provided to fasten said first body to a structure such that vibrations of the structure are transmitted to said first body (24).

2. Apparatus according to claim 1, characterized in that said first body (24) substantially has the shape of an open box (25,26,27;48,49).

3. Apparatus according to claim 1 or 2, characterized in that said second body comprises a plurality of substantially parallel bodies (30).

* * * * *